US005515758A

United States Patent [19]

Bechmann

[11] Patent Number: 5,515,758

[45] Date of Patent: May 14, 1996

[54] METHOD AND A DEVICE OF CUTTING THE COVER FOIL OF A LAMINATED FOIL MATERIAL

[76] Inventor: Peter Bechmann, Malensteinweg 2 D-82487, Oberammerqau, Germany

[21] Appl. No.: 234,564

[22] Filed: Apr. 28, 1994

[30] Foreign Application Priority Data

May 10, 1993 [DE] Germany ..... 43 15 539.1

[51] Int. Cl.[6] ..... B26D 3/08

[52] U.S. Cl. ..... 83/880; 83/881; 83/74

[58] Field of Search ..... 83/880, 74, 368, 83/879, 881; 451/9

[56] References Cited

U.S. PATENT DOCUMENTS

| | | | |
|---|---|---|---|
| 3,801,089 | 4/1974 | Fukugami et al. | 83/74 |
| 3,880,028 | 4/1975 | Frederick, Jr. | 83/880 |
| 3,897,659 | 8/1975 | Henry | 451/5 |
| 4,736,625 | 4/1988 | Patterson et al. | 73/104 |
| 4,920,495 | 4/1990 | Pilkington | 83/881 |
| 5,038,654 | 8/1991 | Mackay | 83/880 |
| 5,222,329 | 6/1993 | Yu | 451/10 |

*Primary Examiner*—Kenneth E. Peterson
*Attorney, Agent, or Firm*—Ratner & Prestia

[57] ABSTRACT

In a process for cutting the cover foil of a laminated foil material, the sound field scanned by the cutting contact of the cutting edge is evaluated for controlling the depth of penetration of the cutting edge maximally up to the plane separating the cover foil from the carrier foil of the foil material.

9 Claims, 2 Drawing Sheets

METHOD AND A DEVICE OF CUTTING THE COVER FOIL OF A LAMINATED FOIL MATERIAL

Figure 1:
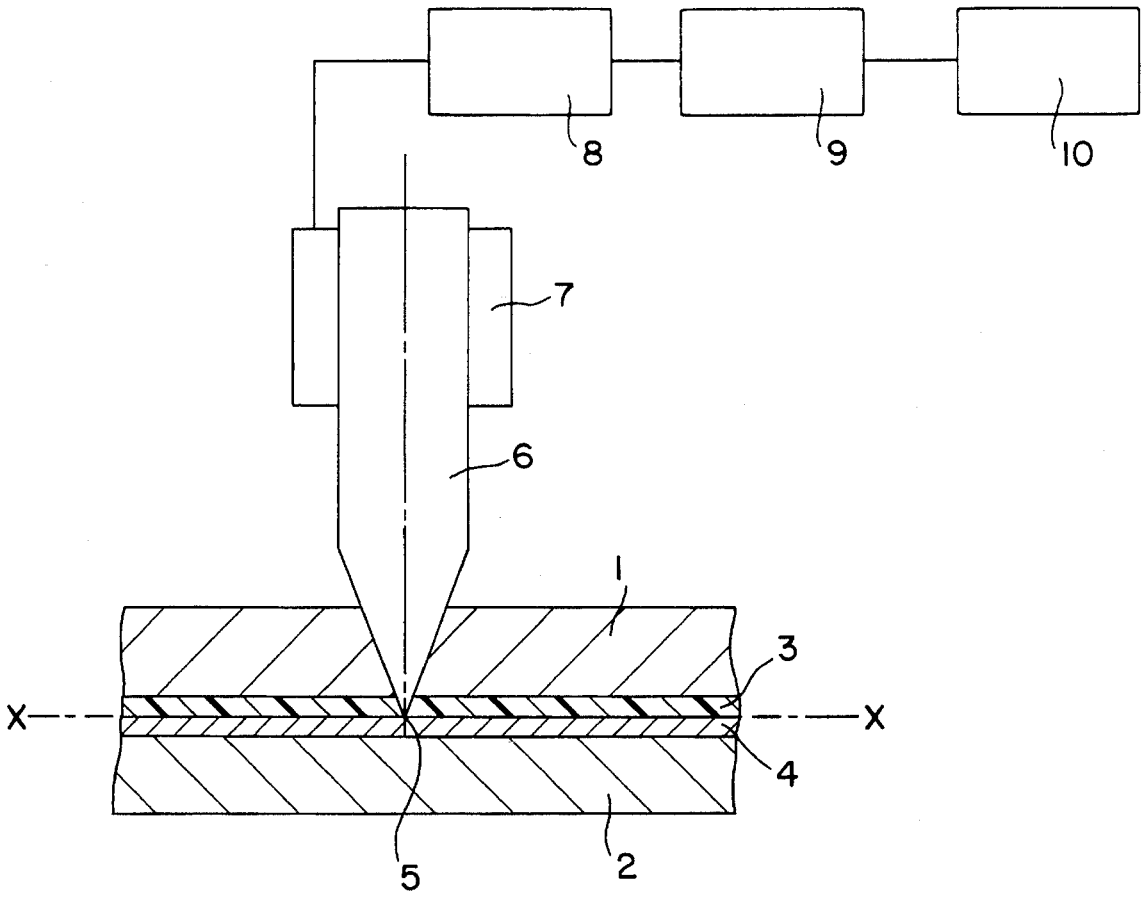

The present invention relates to a process and a device for cutting the cover foil of a laminated foil material.

The cutting of only the cover foil of a laminated foil material is carried out, e.g., during the preparation of so-called foil prints, where a cutting tool is moved by means of a cutting plotter in relation to the foil material. The cutting edge of the cutting tool is adjusted to a depth of penetration which reaches at least the separation plane between a cover foil and a carrier foil of the foil material, so that it is thus ensured, even in combination with a generally tangential orientation of the cutting edge of the cutting tool to the course of the incision, which is predetermined via a control means of the cutting plotter, that the foil print obtained with this incision can be neatly separated from the cover foil when the cover foil is removed from the carrier foil and the foil print consequently initially still remains on the carrier foil and is removed therefrom only later.

On the other hand, difficulties arise in connection with this so-called stripping of the cover foil of a laminated foil material if the incisions of the cover foil, with which, e.g., a predetermined foil print is obtained, have turned out not to be regular. Irregularities in the incisions may be caused, e.g., by the fact that the material thickness of the cover foil along the incision changed due to the manufacturing process, as a result of which it is no longer guaranteed that the plane separating the cover foil from the carrier foil will be reached. The strength properties of the cover foil could also change along the incision due to the manufacturing conditions and thus they could also disturb the original contact position of the cutting edge, and this subsequent influence may also be brought about by unevennesses in the support of the foil material.

To improve the quality of cutting in view of such disturbing influences, a cutting means is known from DE 37 29 208 C1, in which a leaf spring acts on the cutting tool arranged on a pivotable arm on a roller cutting plotter, and the spring force of the leaf spring, transmitted to the cutting edge, changes depending on the depth of penetration. However, such a variable spring force does not make it possible to take into account, from the beginning, all the parameters which may critically influence the incisions in the cover foils when laminated foil materials of different manufacturers are used. In addition, it can be assumed that the material properties of the leaf spring also lead to a variable influence on the conditions of contact of the cutting edge of the cutting tool, and premature fatigue phenomena of the leaf spring, which would justify replacement, are not always detected immediately.

The basic object of the present invention is to provide a process and a device for cutting the cover foil of a laminated foil material, which can offer a better guarantee of obtaining regular incisions in the cover foil during the establishment of an incision limited to the cover foil only, so that a neat and correspondingly problem-free separation of, e.g., a foil print, which is intended to remain on the carrier foil of the foil material and was formed with such incisions in the cover foil, will be achieved during the stripping of the cover foil.

The process according to the present invention for cutting the cover foil of a laminated foil material, in which an incision is made in the cover foil with a cutting tool, whose cutting edge is adjusted to a depth of penetration reaching at least the plane separating the cover foil from a carrier foil of the foil material, consists of a first sound field, scanned by a sound pick-up during a cutting contact of the cutting edge with only the cover foil of the foil material, being differentiated from a second sound field, which is scanned by a sound pick-up during a cutting contact of the cutting edge with the carrier foil. These different sound fields at the cover foil, on the one hand, and at the carrier foil, on the other hand, which are differentiated from one another, are then taken into account when an incision is being made such that any deviation of the first sound field, which deviation is influenced by the second sound field, is evaluated for a new adjustment of the cutting edge to the depth of penetration, which is thus predetermined, at which only the first sound field can be scanned.

Thus, the process according to the present invention utilizes the discovery that sound vibrations are generated by the cutting contact of the cutting edge with the cover foil of a laminated foil material, which is of interest in this connection, as a consequence of a change in density in space and time, and that because of the deviating density of the carrier foil, these sound vibrations must necessarily lead to a frequency that is different from that of the sound vibrations of the carrier foil. Since scanning these different sound vibrations and differentiating them from one another causes no technical difficulties at all, a simple precautionary measure can thus be taken to ensure that the cutting edge of the cutting tool will always remain adjusted to the depth of penetration or that it is readjusted to that depth of penetration, in which complete cutting through of the cover foil will take place, because it is only necessary to accurately adjust the limit value, from which penetration into the sound field of the carrier foil will take place, during an initial comparison of the two sound values.

In the case of the foil materials processed by means of cutting plotters in the conventional manner, the adjustment of such a limit value is obviously facilitated by the fact that the cover foil is connected to the carrier foil via an adhesive layer, and the carrier foil usually consists of a carrier paper coated with a wax layer. Since the adhesive layer of the cover foil, on the one hand, and the wax layer of the carrier paper, on the other hand, have completely different densities, it is also possible to determine even two correspondingly greatly different sound fields, and it is considered to be advantageous within the framework of the process according to the present invention to adjust the depth of penetration of the cutting edge of the cutting tool maximally up to the plane separating the adhesive layer from the carrier foil, on the one hand, so that the first sound field is scanned with the sound vibrations influenced by the cover foil and by the adhesive layer, while, on the other hand, the second sound field can be scanned only with the sound vibrations influenced by the wax layer.

It is usually advantageous when the process according to the present invention is carried out for the sound field existing during the preparation of an incision to be continuously scanned by means of a sound pickup, so that a readjustment of the depth of penetration of the cutting edge of the cutting tool can immediately be performed in response to a deviation thus detected. However, if the foil material can be assumed to be of extensively uniform quality, scanning the existing sound field during the preparation of an incision only periodically at predetermined time intervals or even only at predetermined measurement points of the path of movement of the cutting tool may also be considered to be sufficient as an alternative.

The scanning of the actually existing sound field, which is performed by means of a sound pickup, is preferably used for converting the sound vibrations present into electrical vibrations, which can be filtered by an electrical filter, so that a control signal, with which the depth of penetration of the cutting edge can be readjusted, can be derived from a detected deviation of the sound vibrations of the first and second sound fields from an adjusted limit value. The control signal may be sent to a servomotor, which influences the lowering and raising of the cutting tool in a cutting plotter, which indicates that the process according to the present invention can be integrated within conventional cutting plotters without a major extra expense.

To design a device according to the present invention for cutting the cover foil of a laminated foil material, a sound pickup, e.g., a microphone, is therefore primarily provided; the said microphone is preferably arranged at the cutting tool, and for sound analysis it is connected, via an amplifier if necessary, to an electrical filter, which supplies only the control signal, with which, e.g., the servomotor, which is present in a cutting plotter for moving the cutting tool, is controlled for resetting the depth of penetration of the cutting edge. As an alternative, it would also be possible to use this control signal to regulate a pressure force with which the depth of penetration of the cutting edge of the cutting tool is predetermined.

An exemplary embodiment of the present invention is schematically represented in the drawings and will be explained in greater detail below.

Figure 2A:
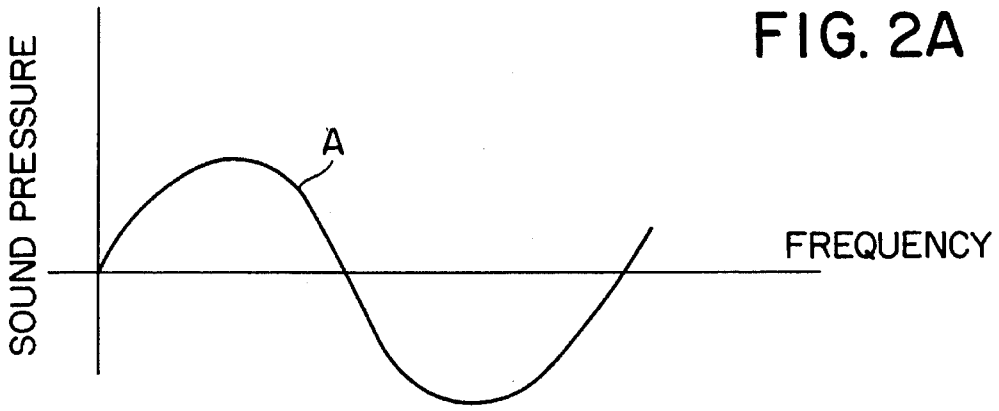
Figure 2B:
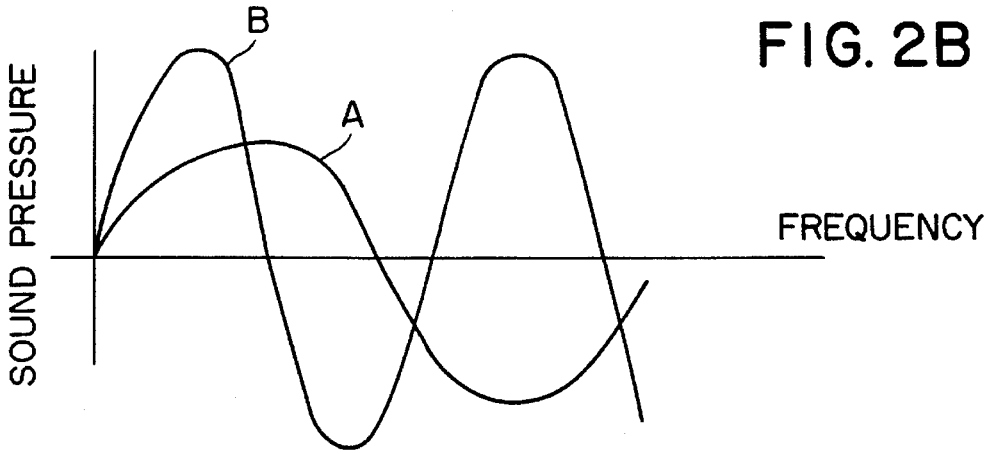
Figure 2C:
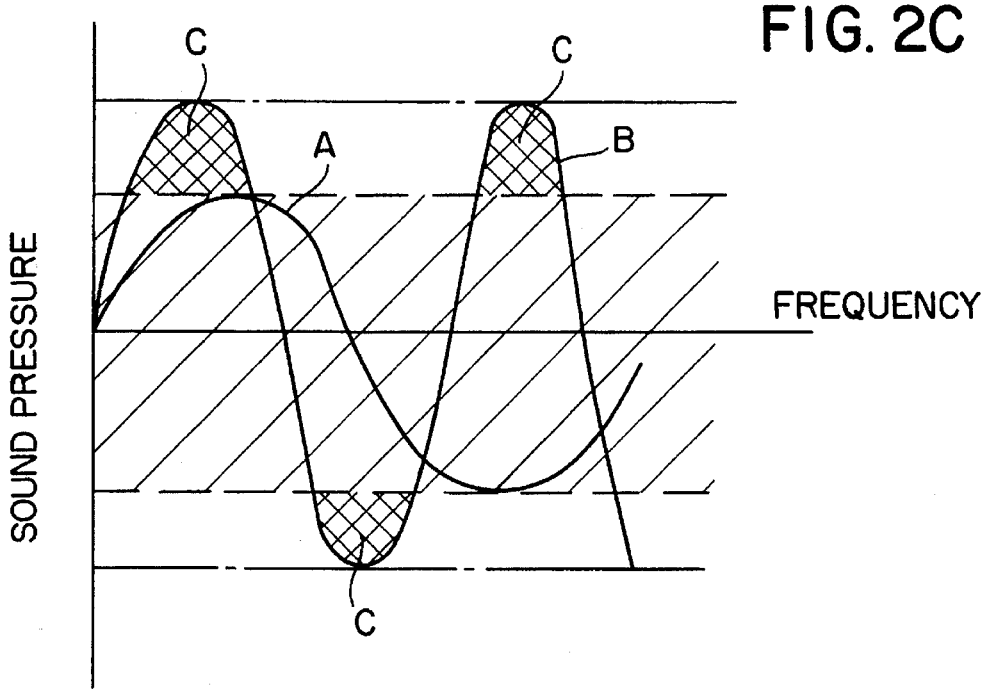

FIG. 1 shows a schematic representation for explaining the process in greater detail and FIGS. 2A–2C show different sound pressure-versus-frequency diagrams, which are significant for the process.

FIG. 1 shows a fragment of a foil material, which consists of a cover foil 1 and a carrier paper 2, wherein the cover foil 1 is adhered to a wax layer 4 of the carrier paper via an adhesive layer 3. Such a foil material is used for making, e.g., foil prints by means of cutting plotters, in which a cutting tool is moved in relation to the foil material and penetrates with its cutting edge 5 into the cover foil 1 to a separation plane X—X, which is formed, at the maximum, between the adhesive layer 3 and the wax layer 4. The incision made in the cover foil 1 with the cutting edge 5 of the cutting tool 6 forms, in agreement with a predetermined pattern, which is converted by a control device of the cutting plotter, e.g., a foil print, which remains on the wax layer 4 of the cover foil 2 with a so-called stripping of the cover foil 1 and can be removed from it later to be applied to an advertising space in a self-adhesive manner.

A sound pickup 7, with which the sound vibrations generated by the cutting contact of the cutting edge 5 with the foil material can be scanned, is arranged at the cutting tool 6. These sound vibrations lead, e.g., to the sinusoidal pattern of the sound pressure-versus-frequency curve A shown in the upper diagram in FIG. 2 in the case of the cover foil 1, and this curve is obtained more accurately with a depth of penetration of the cutting edge 5 of the cutting tool 6 which reaches the separation plane X—X at the wax layer 4 of the carrier foil 2. However, if the cutting edge of the cutting tool is adjusted to a depth of penetration reaching into the wax layer 4 of the carrier foil 2, sound vibrations, whose sound pressure-versus-frequency curve is described by curve B, which is shown in the middle part of FIG. 2, are obtained because of the different density of the wax layer 4.

If the depth of penetration of the cutting edge 5 of the cutting tool 6 is adjusted to the separation plane X—X during the establishment of an incision in the cover foil 1, the sound pickup 7 scans a sound field which can be analyzed by an electrical filter 9 connected via an inserted amplifier 8 as the sound field which ensures, in agreement with the sound pressure-versus-frequency curve A in FIG. 2A, that complete incisions, which will make possible a neat stripping of the cover foil later, will be made in the cover foil 1. Thus, no control signal, with which a servomotor 10, with which the cutting edge 5 of the cutting tool 6 is adjusted to the separation plane X—X at the beginning of the preparation of an incision, can otherwise be controlled, is sent in this case via the output of the filter 9.

Should the cutting edge 5 penetrate into the wax layer 4 of the carrier foil 2 during the establishment of the incision, the sound pickup 7 would scan a sound field, whose sound vibrations correspond to the sound pressure-versus-frequency curve B in FIG. 2B. Thus, there will be a deviation from the first sound field, which is indicated by the sound pressure-versus-frequency ranges C in FIG. 2C, and a control signal is thus then sent through the filter 9 due to this deviation, and the servomotor 10 can be actuated with this control signal for restoring the initial depth of penetration of the cutting edge 5 at the separation plane X—X. The deviation, influenced by the wax layer 4, of the first sound field which is obtained with the sound vibrations of the sound pressure-versus-frequency curve A, is also achieved in an equivalent manner if the material thickness or even the strength properties of the cover foil 1 change, because the cutting edge 5 would be separated from the separation plane X—X in this case, as a result of which a corresponding control signal is also provided by the filter 9 in order to actuate the servomotor 10 for a new adjustment of the cutting edge of the cutting tool.

I claim:

1. Process for cutting a cover foil of a laminated foil material, wherein an incision is made in the cover foil with a cutting tool, whose cutting edge is adjusted to a depth of penetration reaching at least a plane separating the cover foil from a carrier foil of a foil material, wherein a first sound field, which is scanned by a sound pickup during a cutting contact of the cutting edge with the cover foil only, is differentiated from a second sound field, which is scanned by the sound pickup during a cutting contact of the cutting edge with the carrier foil, and wherein any deviation of the first sound field, which deviation is influenced by the second sound field during an establishment of the incision, is evaluated for a new adjustment of the cutting edge of the cutting tool to a predetermined depth of penetration, which is scanned only with the first sound field.

2. Process according to claim 1, wherein the cover foil is connected to the carrier foil via an adhesive layer, and the depth of penetration of the cutting edge of the cutting tool is adjusted not further than the plane separating this adhesive layer from the carrier foil, wherein the first sound field is scanned with the sound vibrations influenced by the cover foil and by the adhesive layer.

3. Process according to claim 1, wherein the carrier foil is formed with a carrier paper coated with a wax layer, and the second sound field is scanned with the sound vibrations influenced by the wax layer.

4. Process according to claims 1, wherein the sound field present during the establishment of the incision is continuously scanned.

5. Process according to claim 1, wherein the sound field present during the establishment of the incision is scanned periodically at predetermined time intervals.

6. Process according to claim 1, wherein the sound field present during the establishment of the incision is scanned at predetermined measurement points along the path of movement of the cutting tool.

7. Process according to claim 1, wherein the sound field present during the establishment of the incision is scanned by a sound pickup, and the sound vibrations present are converted into electrical vibrations and are filtered by an electrical filter in order to generate a control signal, with which the depth of penetration of the cutting edge is reset to the plane separating the cover foil from the carrier foil of the foil material, when a deviation from the sound vibrations of the first sound field is detected.

8. A process according to claim 7, further comprising the steps of amplifying the output signal of said sound pick-up and providing the amplified output signal to said electrical filter.

9. The process according to claim 7, wherein the said control signal controls a servo motor which positions said cutting tool.

* * * * *